US012352116B2

(12) United States Patent
Morin et al.

(10) Patent No.: US 12,352,116 B2
(45) Date of Patent: Jul. 8, 2025

(54) VISCOUS DAMPENING COMPONENT FOR USE WITH EARTH-BORING ROTARY DRILL BITS, AND EARTH-BORING ROTARY DRILL BITS INCLUDING A VISCOUS DAMPENING COMPONENT

(71) Applicant: Baker Hughes Oilfield Operations LLC, Houston, TX (US)

(72) Inventors: John Morin, The Woodlands, TX (US); Armin Kueck, The Woodlands, TX (US)

(73) Assignee: Baker Hughes Oilfield LLC, Houston, TX (US)

( * ) Notice: Subject to any disclaimer, the term of this patent is extended or adjusted under 35 U.S.C. 154(b) by 0 days.

(21) Appl. No.: 18/543,214

(22) Filed: Dec. 18, 2023

(65) Prior Publication Data

US 2025/0198242 A1 Jun. 19, 2025

(51) Int. Cl.
*E21B 17/07* (2006.01)
*E21B 10/42* (2006.01)
*E21B 17/10* (2006.01)

(52) U.S. Cl.
CPC ..... *E21B 17/1078* (2013.01); *E21B 10/42* (2013.01); *E21B 17/07* (2013.01); *E21B 17/076* (2013.01)

(58) Field of Classification Search
CPC ..... E21B 17/07; E21B 17/076
See application file for complete search history.

(56) References Cited

U.S. PATENT DOCUMENTS 2,756,022 A * 7/1956 Sturgeon ..... E21B 17/07 285/302
2011/0067965 A1* 3/2011 McAndrews ..... F16F 9/504 188/275
2015/0219221 A1* 8/2015 Gamache ..... F16C 33/72 277/427
2020/0018124 A1* 1/2020 Hohl ..... E21B 17/1042
2020/0018377 A1* 1/2020 Hohl ..... F16F 15/1207
2021/0079738 A1* 3/2021 Peters ..... F16F 15/173
2021/0079976 A1* 3/2021 Peters ..... F16F 9/52
2021/0189806 A1* 6/2021 Simanowski ..... F16F 15/1435
2022/0195812 A1* 6/2022 Volgmann ..... E21B 17/07
2023/0142360 A1* 5/2023 Shen ..... E21B 17/07 175/57

FOREIGN PATENT DOCUMENTS

WO WO-2021202484 A1 * 10/2021 ..... E21B 17/07

* cited by examiner

*Primary Examiner* — Giovanna Wright
(74) *Attorney, Agent, or Firm* — Baker Hughes Company

(57) ABSTRACT

A viscous dampening component is provided for use with a drill bit. The viscous dampening component may include an inertial mass ring configured to surround a shank of a drill bit, a cover configured to surround the inertial mass ring and the shank to position and maintain the inertial mass ring on the shank, and a viscous fluid disposed between the inertial mass ring and the shank. When the inertial mass ring rotates relative to the shank of the drill bit, energy is dissipated within the viscous fluid.

20 Claims, 4 Drawing Sheets

VISCOUS DAMPENING COMPONENT FOR USE WITH EARTH-BORING ROTARY DRILL BITS, AND EARTH-BORING ROTARY DRILL BITS INCLUDING A VISCOUS DAMPENING COMPONENT

TECHNICAL FIELD

This disclosure relates generally to earth-boring rotary drill bits. More specifically, this disclosure relates to viscous dampening components for energy dissipation in earth-boring rotary drill bits, and to earth-boring rotary drill bits including such viscous damping components.

BACKGROUND

Drill bits are tools used in industries such as the oil and gas industry to create boreholes in the earth's crust. Such drill bits may be used to create boreholes for the extraction of hydrocarbons such as crude oil and natural gas. Some drill bits may include roller cone drill bits that have teeth milled into the roller cones or tungsten carbide inserts pressed into the roller cones that are configured to indent and impact a formation. Some drill bits may comprise blades having polycrystalline diamond cutters that are configured to scrape and shear away material from a formation. So called "hybrid" drill bits include both roller cones and blades with fixed cutters thereon. During use, due to impacts between the drill bit and the formation, drill bits may experience vibrations. In some applications, such vibrations may be harmful to the drill bit or cutting elements and other components of the drill bit.

BRIEF SUMMARY

According to some embodiments, a viscous dampening component is provided for use with an earth-boring rotary drill bit. The viscous dampening component may include an inertial mass ring configured to surround a shank of a drill bit, a cover configured to surround the inertial mass ring and the shank to position and maintain the inertial mass ring on the shank, and a viscous fluid disposed between the inertial mass ring and the shank. When the inertial mass ring rotates relative to the shank of the drill bit, energy is dissipated to the viscous fluid.

According to some embodiments, an earth-boring rotary drill bit may comprise a shank, a bit portion attached to and extending from the shank, the bit portion comprising one or more cutting elements, and a viscous dampening component. The viscous dampening component may include an inertial mass ring configured to surround a shank of a drill bit, a cover configured to surround the inertial mass ring and the shank to position and maintain the inertial mass ring on the shank, and a viscous fluid disposed between the inertial mass ring and the shank. When the inertial mass ring rotates relative to the shank of the drill bit, energy is dissipated to the viscous fluid.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

Figure 1:
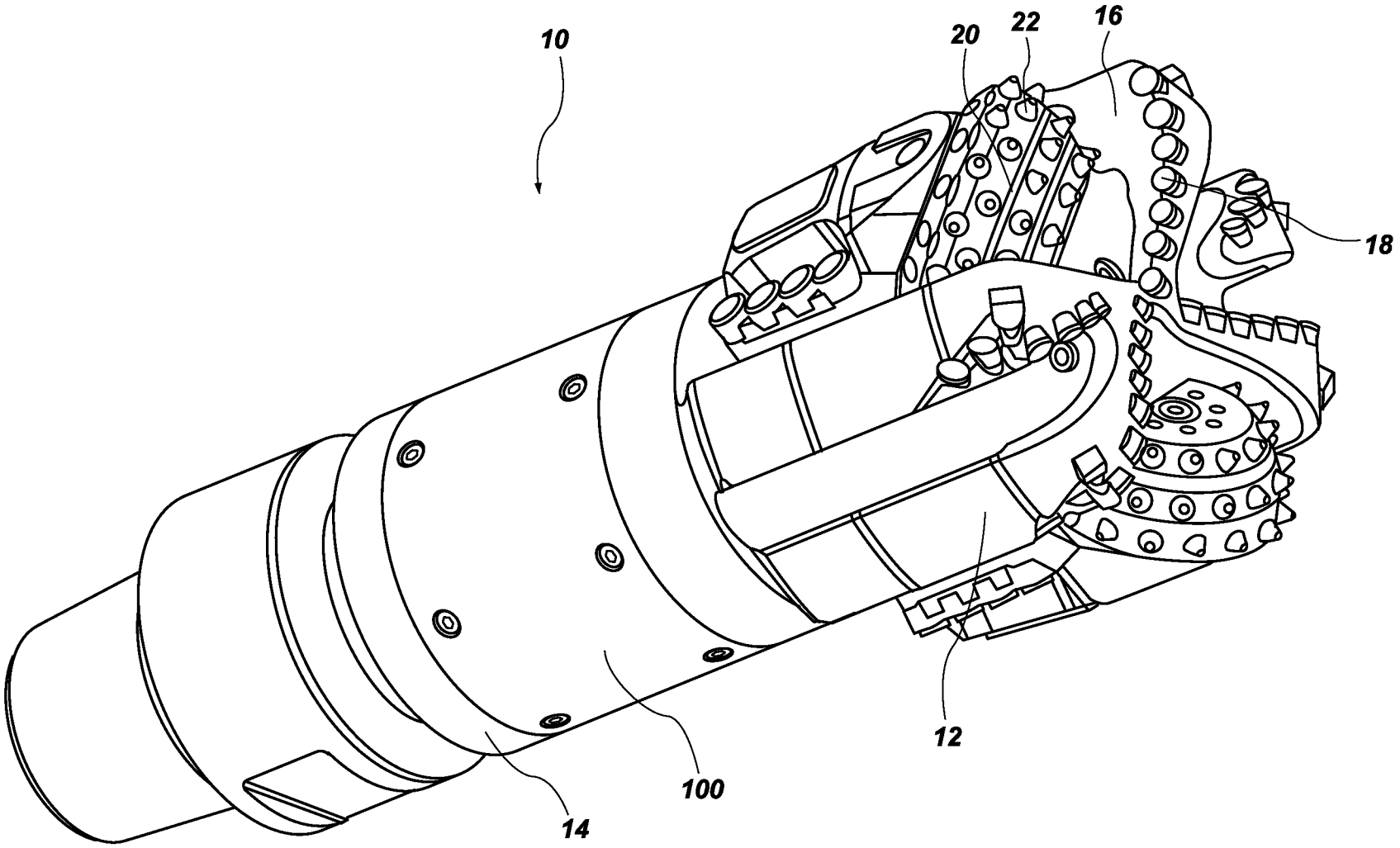
FIG. 1 is a perspective view of a drill bit with a viscous dampening component according to some embodiments.

The illustrations presented herein are not actual views of any drill bit or viscous dampening component, or any component thereof, but are merely idealized representations, which are employed to describe embodiments of the present invention.

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, any relational term, such as "first," "second," "top," "bottom," "upper," "lower," "above," "beneath," "side," "upward," "downward," etc., is used for clarity and convenience in understanding the disclosure and accompanying drawings, and does not connote or depend on any specific preference or order, except where the context clearly indicates otherwise. For example, these terms may refer to an orientation of elements of any drill bit or viscous dampening component when utilized in a conventional manner. Furthermore, these terms may refer to an orientation of elements of any drill bit or viscous dampening component as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

FIG. 1 is a perspective view of an earth-boring rotary drill bit 10 with a viscous dampening component 100 according to an embodiment of the present disclosure. The viscous dampening component 100 may provide a dampening effect to dissipate energy from vibrations experienced at the drill bit. For example, when the drill bit 10 experiences a sudden acceleration during a drilling operation, the energy may be dissipated as heat via the viscous dampening component 100.

As shown in FIG. 1, the drill bit 10 comprises a bit portion 12 at a distal end of a shank 14. The bit portion 12 may comprise one or more blades 16. Each of the blades 16 may comprise a plurality of polycrystalline diamond cutters 18 ("PDC cutters"). In some embodiments, one or more roller cones 20 may be disposed between the blades 16. The roller cones 20 may comprise a plurality of tungsten carbide inserts 22 ("TCI cutters"). In other embodiments, the drill bit 10 may include only blades 16 with fixed PDC cutters 18 thereon, or the drill bit 10 may include only roller cones 20 with cutting elements or structures thereon.

During use, the PDC cutters 18 on the blades 16 may be configured to scrape material from a formation while the TCI cutters 22 on the roller cones may be configured to indent and crush against a formation. Impacts to the drill bit 10 during operation may cause potentially harmful torsional vibrations. In some conditions, vibrations may worsen and affect performance of the drill bit 10 or other components of a bottom hole assembly, which may result in equipment failures. Accordingly, the drill bit 10 comprises a viscous dampening component 100 disposed on the shank 14 of the drill bit. The viscous dampening component 100 may be configured to dissipate torsional vibrations experienced during use of the drill bit 10.

Figure 2:
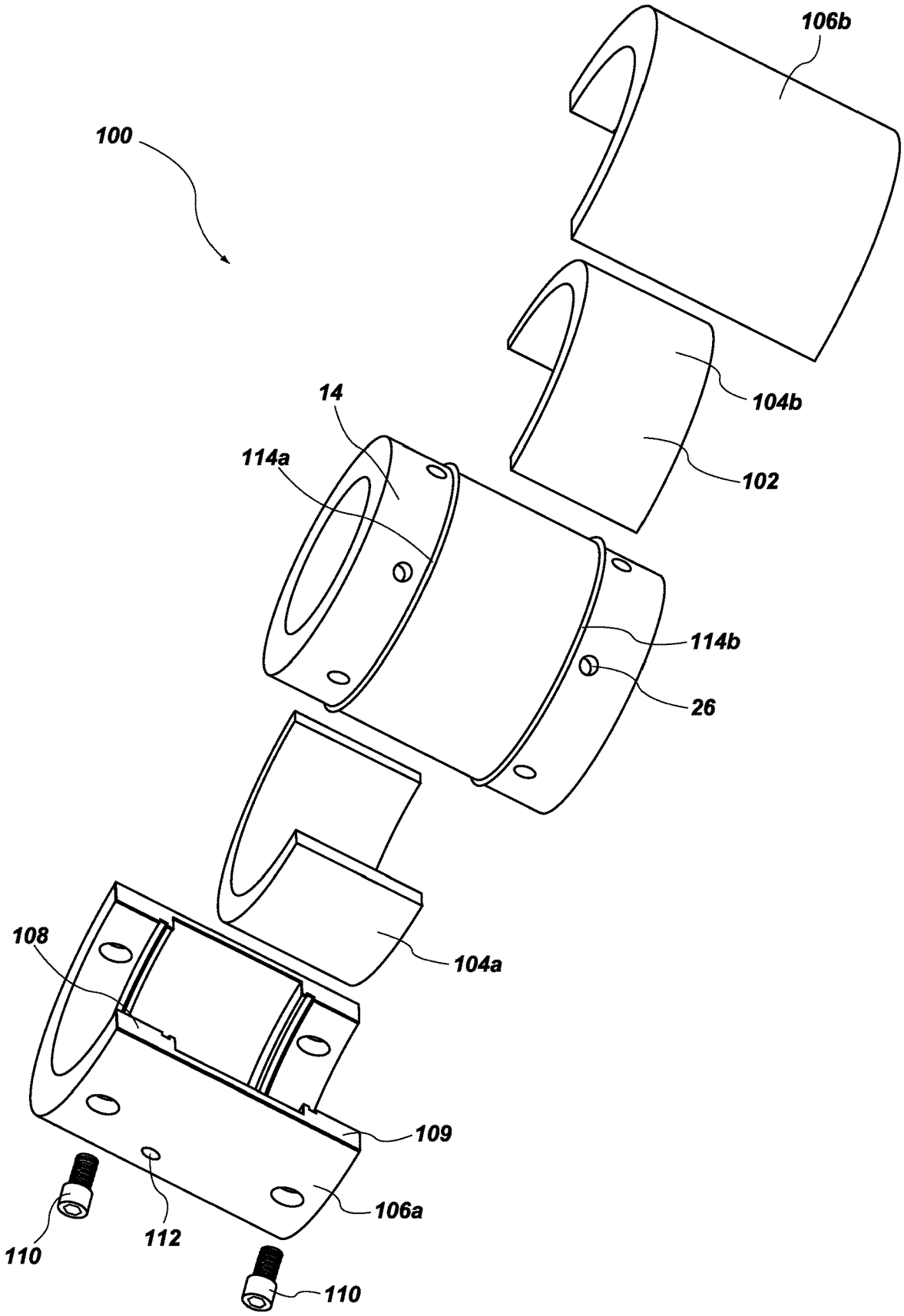
FIG. 2 is an exploded view of a viscous dampening component for a drill bit according to some embodiments.

FIG. 2 is an exploded view of the viscous dampening component 100 in isolation from the other components of the drill bit 10. The viscous dampening component 100 may comprise an inertial mass ring 102. The inertial mass ring 102 may be formed from a first half-cylindrical portion 104*a* and a second half-cylindrical portion 104*b*. Each of the first and second half-cylindrical portions 104*a*, 104*b* are configured to surround the shank 14 of the drill bit 10. While the inertial mass ring 102 is shown in first and second half-cylindrical portions 104*a*, 104, the inertial mass ring 102 may also be formed in more than two portions to surround the shank 14 of the drill bit 10.

The inertial mass ring 102 may be formed from any suitable material such as a tungsten or a steel alloy. In some embodiments, the inertial mass ring 102 may be formed from a material having a density that is equal to or greater than a density of a material of a body of the drill bit 10. In some embodiments, the inertial mass ring 102 may have an average density that is at least 125%, at least about 150%, at least about 175%, or even at least about 200% of the average density of the body of the drill bit 10. As non-limiting examples, the average density of the inertial mass ring 102 may be at least about 8 g/cm$^3$, at least about 10 g/cm$^3$, or even at least about 12 g/cm$^3$. The average density of the inertial mass ring 102 may be defined as the total mass of the inertial mass ring 102 divided by the volume of the inertial mass ring 102. In some embodiments, the inertial mass ring 102 may be formed from multiple materials such as from a steel alloy comprising tungsten inserts.

The inertial mass ring 102 may have a machined finish with low surface roughness, such as a surface roughness in a range extending from about 23 microns to about 64 microns RMS. In some embodiments, the inertial mass ring 102 may comprise a coating, such as a ceramic coating. In some embodiments, the surface finish may be a mirror-like polished finish having a surface roughness in a range extending from about 4 microns to 10 microns. In some embodiments, the surface finish may be very rough having a surface finish of up to about 2200 microns. The surface finish of the inertial mass ring 102 or the coating on the inertial mass ring 102 may be selected based at least in part on a desired friction between the inertial mass ring 102 and the shank 14. For example, a higher friction between the inertial mass ring 102 and the shank 14 may tune the viscous dampening component to provide an increased dampening effect.

The viscous dampening component 100 may further comprise a first cover 106*a* and a second cover 106*b*. The first and second covers 106*a*, 106*b* are configured to surround the inertial mass ring 102 and the shank 14 to position and maintain the inertial mass ring 102 on the shank 14. The first and second covers 106*a*, 106*b* may be formed from any suitable material such as a tungsten, steel, or an aluminum alloy. While first and second covers 106*a*, 106*b* are shown and described herein, it will be understood that a cover separated into more than two covers could also be used to surround the inertial mass ring 102 and the shank 14.

A gasket 108 (e.g., a face seal) may be provided on a side face 109 of the first and second covers 106*a*, 106*b*. The gasket may be configured to provide a seal between the first and second covers 106*a*, 106*b* when the covers 106*a*, 106*b* are assembled onto the shank 14. Fasteners 110 may be provided to attach the covers 106*a*, 106*b* to the shank 14 and to clamp the covers 106*a*, 106*b* over the inertial mass ring. In some embodiments, the shank 14 may comprise a plurality of threaded holes 26 tapped into the shank, and the fasteners 110 may comprise screws that are threaded into the threaded holes 26.

Figure 3:
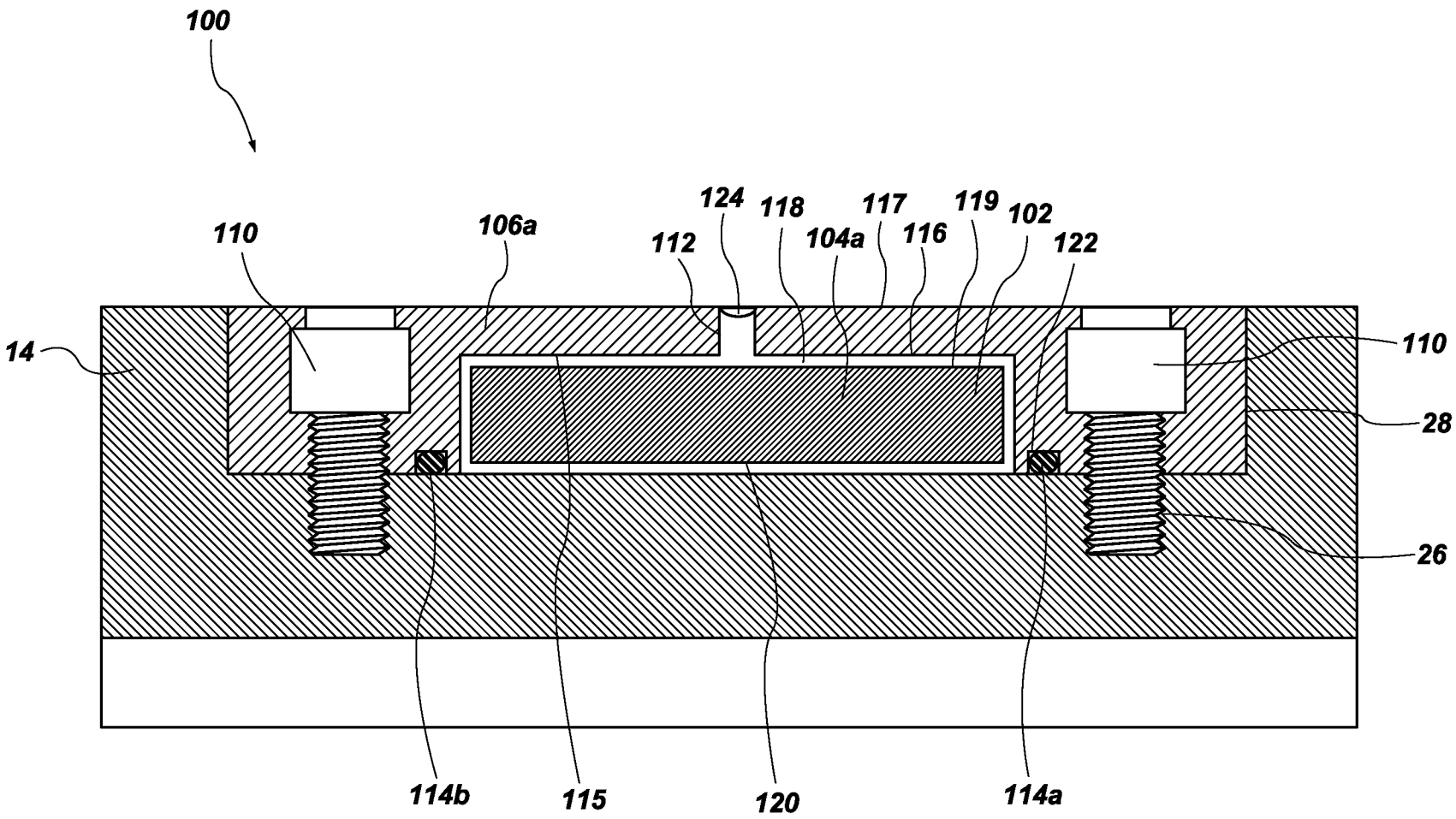
FIG. 3 is a section view of a viscous dampening component for a drill bit according to some embodiments.

FIG. 3 is a section view of a viscous dampening component for a drill bit according to some embodiments. Referring to FIGS. 2 and 3, The covers 106*a*, 106*b* may be formed in a half-cylindrical shape so as to conform to an outside surface of the shank 14. An annular channel 116 may be formed on an inside surface 115 of the covers 106*a*, 106*b*. The annular channel 116 may be sized to fit around the inertial mass ring 102.

The covers 106*a*, 106*b* are further configured to fit within an annular channel 28 formed in the shank 14. The covers 106*a*, 106*b* may have a thickness substantially similar to the depth of the annular channel 28 of the shank such that an outer surface 117 of the of the covers 106*a*, 106*b* are substantially flush with an outer surface of the shank 14. This may help ensure that the viscous dampening component does not interfere with a cutting structure of the drill bit 10.

The covers 106*a*, 106*b* may further comprise an inlet port 112 extending from the outer surface 117 to the inside surface 115 of the covers 106*a*, 106*b* providing access to the annular channel 116. The inlet port 112 may be configured to facilitate insertion of a viscous fluid into the annular channel 116.

For example, the annular channel 116 may be sized such that the viscous fluid 118 may be inserted into the annular channel 116 via the inlet port 112 to be disposed between the inside surface 115 of the annular channel and an outside surface 119 of the inertial mass ring 102. The viscous fluid 118 may also be configured to be disposed between an inside surface 120 of the inertial mass ring 102 and an outside surface of the shank 14 of the drill bit 10. The viscous fluid 118 may comprise any suitable viscous fluid that is stable over a relatively large range of temperatures. For example, the viscous fluid 118 may comprise a hydraulic fluid such as a silicone fluid. However, any suitable viscous fluid may be used based on a given application. It is noted that the space between the inside surface 115 of the covers 106*a*, 106*b*, and the space between the inside surface 120 of the inertial mass ring 102 shown in FIG. 3 are not necessarily to scale but are shown to aid in understanding of the viscous dampening component 100. In some embodiments, tolerances between the inertial mass ring 102 and the shank 14 may be between about 0.5 thousandth and about 5 thousandths of an inch. In some embodiments, the tolerances may be up to 1 mm. This is not intended to be limiting, and the tolerances may be any desired tolerances depending on the application.

The covers 106*a*, 106*b* may further comprise annular grooves 122. The annular grooves 122 may be configured to accommodate and seal against first and second O-rings

114*a*, 114*b*. The first O-ring 114*a* may be configured to be on a first side of the inertial mass ring 102, and the second O-ring 114*b* may be configured to be on a second side of the inertial mass ring 102, opposite the first side. The first and second O-rings 114*a*, 114*b* and the gasket 108 may be configured to ensure that the viscous fluid 118 is sealed within the annular channel 116.

Figure 4:
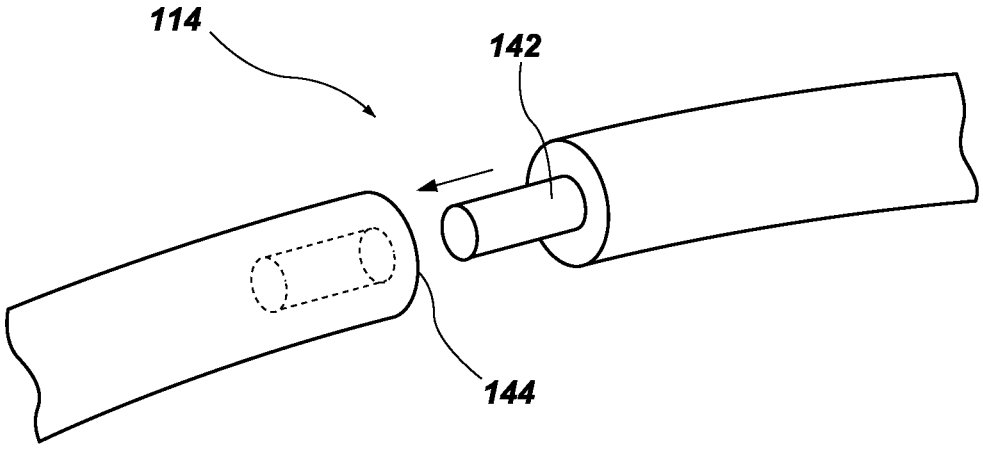
FIG. 4 is an enlarged view of an O-ring construction according to some embodiments.

FIG. 4 shows an enlarged view of an O-ring 114. To fit into a bottom of the channel 28 of the shank 14, the O-ring 14 may be constructed such that the O-ring 114 comprises a male end 142 that is configured to interface with a female end 144. The O-ring 114 may be configured to wrap around the shank 14 within the channel 28 such that the male end 142 is inserted into the female end 144 so that the O-ring 144 surrounds the shank within the channel 28. In some embodiments, heat may be applied to the connected male end 142 and female end 144 to fuse the male end 142 and female end 144 together to form a complete seal.

With the covers 106*a*, 106*b* clamped over the inertial mass ring 102, and with the viscous fluid 118 within the annular channel 116, the inertial mass ring 102 and viscous fluid may provide a torsional dampening effect to dissipate energy of torsional vibrations within the drill bit 10. For example, when the drill bit 10 experiences sudden accelerations (e.g., vibrations) during a drilling operation, the vibrations may be dampened via the viscous dampening component 100. The vibrations may cause relative movement between the inertial mass ring 102 and the shank 14 creating a fluid shear zone between the inertial mass ring 102 and the shank 14. Energy may be dissipated as heat due to the friction between the inertial mass ring 102 and the shank 14 and the viscous fluid 118. This may dampen the torsional vibrations within the drill bit 10. In some examples, a maximum amplitude of the relative rotation between the inertial mass ring 102 and the shank 14 of the drill bit 10 to dissipate vibrations experienced by the drill bit 10 may be about 3 degrees. The viscous dampening component 100 may further aid to resist sudden angular accelerations of the drill bit 10 by increasing a moment of inertia of the drill bit 10.

The viscous dampening component 100 may provide several advantages to the drill bit 10. For example, because energy from angular vibrations may be dissipated via the viscous dampening component, the durability of the drill bit 10, and a bottom hole assembly including the drill bit may be increased. This may allow the drill bit 10 and the bottom hole assembly to have a longer useful lifespan. Further, the drill bit 10 may have a wider range of allowable weight-on-bit ("WOB") and revolutions per minute ("RPM") without the risk of damaging torsional vibrations as compared to conventional drill bits.

In some applications, the drill bit 10 may be exposed to relatively high pressures, such as deep within a borehole. To ensure that the viscous fluid 118 remains within the annular channel 116, the viscous dampening component may comprise a pressure compensating device 124, such as an elastomeric diaphragm. The pressure compensating device 124 may be configured to pressurize an internal pressure of the viscous fluid 118 to substantially match a pressure of an external environment. In some embodiments, the pressure compensating device may be disposed within the inlet port 112.

Several modifications may be made to the drill bit and the viscous dampening component described herein. For example, while the drill bit 10 shown in FIG. 1 is an exemplary hybrid drill bit, a viscous dampening component, such as viscous dampening component 100 may be incorporated on any suitable drill bit. Furthermore, the drill bit may comprise a variety of sizes based on the application, and the viscous damping component may be sized to fit on the drill bit. As mentioned above, the fluid-type, a gap between the inertial mass ring and the shank, and inertial properties of the inertial mass ring may all be fine-tuned maximize the damping effect for the different bit sizes and configurations.

In some embodiments, the viscous dampening component may be disposed on the shank at a position closer to or farther away from the bit portion 12 as compared to the position shown in FIG. 1. In other examples, the viscous dampening component may be disposed on another portion of a bottom hole assembly separate from the drill bit. Furthermore, any number of such viscous dampening components may be provided at different locations in the bottom hole assembly. In some embodiments, the viscous dampening component may have a length and/or thickness that is relatively larger or smaller than that shown in the figures. In some embodiments, the viscous dampening component may be disposed to be wrapped around the shank or other component of the bottom hole assembly without being within an annular channel. In some embodiments, the drill bit may comprise an annular flange, and the viscous dampening component may be attached to the annular flange.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. A viscous dampening component for use with an earth-boring rotary drill bit, the viscous dampening component comprising:

an inertial mass ring configured to surround a shank of a drill bit and configured to be disposed directly adjacent to the shank within a first annular channel of the shank;

a cover configured to be disposed within the first annular channel of the shank such that an outer surface of the cover is substantially flush with an outer surface of the shank, the cover comprising a second annular channel configured to surround the inertial mass ring to position and maintain the inertial mass ring on the shank;

a viscous fluid disposed between the inertial mass ring and the shank, energy being dissipated to the viscous fluid when the inertial mass ring rotates relative to the shank of the drill bit; and an annular seal disposed on each side of the second annular channel, each annular seal configured to seal the viscous fluid within the second annular channel of the cover.

2. The viscous dampening component of claim 1, wherein the inertial mass ring comprises a first half-cylindrical portion and a second half-cylindrical portion.

3. The viscous dampening component of claim 1, wherein the inertial mass ring is formed from one or more of a steel alloy or a tungsten alloy.

4. The viscous dampening component of claim 1, wherein the inertial mass ring comprises a ceramic coating.

5. The viscous dampening component of claim 1, wherein a surface of the inertial mass ring has a surface roughness in a range extending from about 23 microns to about 64 microns RMS.

6. The viscous dampening component of claim 1, wherein the cover comprises a first cover and a second cover, the first and second cover each having a half-cylindrical shape.

7. The viscous dampening component of claim 1, wherein the cover comprises an inlet port extending from the outer surface of the cover to the second annular channel, the viscous fluid configured to be introduced into the second annular channel via the inlet port.

8. The viscous dampening component of claim 7, further comprising a pressure compensating device disposed within the inlet port, the pressure compensating device configured to equalize a pressure of the viscous fluid with an external environment.

9. The viscous dampening component of claim 1, further comprising fasteners configured to attach the cover to the shank.

10. The drill bit according to claim 1, wherein the cover comprises an annular groove disposed on each side of the second annular channel, each annular groove configured to face a lower surface of the first annular channel of the shank, and wherein the annular seals are disposed in the annular grooves.

11. The drill bit according to claim 10, wherein the annular seals comprise O-rings disposed with the annular grooves.

12. An earth boring rotary drill bit, comprising:

a shank comprising a first annular channel;

a bit portion attached to and extending from the shank, the bit portion comprising one or more cutting elements; and a viscous dampening component comprising:

an inertial mass ring configured to surround the shank and disposed directly adjacent to the shank within the first annular channel;

a cover disposed within the first annular channel such that an outer surface of the cover is substantially flush with an outer surface of the shank, the cover comprising a second annular channel configured to surround the inertial mass ring to position and maintain the inertial mass ring on the shank;

a viscous fluid disposed between the inertial mass ring and the shank, energy being dissipated to the viscous fluid when the inertial mass ring rotates relative to the shank of the drill bit; and an annular seal disposed on each side of the second annular channel, each annular seal configured to seal the viscous fluid within the second annular channel of the cover.

13. The drill bit according to claim 12, wherein a gap between an inner surface of the inertial mass ring and an outer surface of the shank is about 1 mm or less.

14. The drill bit according to claim 12, wherein the cover comprises a first cover and a second cover, the first and second cover each comprising a half-cylindrical shape, a sealing gasket being disposed on a side face of at least one of the first cover or the second cover to provide a seal between the first cover and the second cover.

15. The drill bit according to claim 12, wherein the shank comprises threaded holes and wherein the drill bit further comprises fasteners configured to thread into the threaded holes to attach the cover to the shank.

16. The drill bit according to claim 12, wherein the cover comprises an inlet port extending from the outer surface of the cover to the second annular channel of the cover, the viscous fluid configured to be introduced into the second annular channel of the cover via the inlet port.

17. The drill bit according to claim 16, further comprising a pressure compensating device disposed within the inlet port, the pressure compensating device equalizing a pressure of the viscous fluid with an external environment.

18. The drill bit according to claim 12, wherein the inertial mass ring comprises a first half-cylindrical portion and a second half-cylindrical portion.

19. The drill bit according to claim 12, wherein the first annular channel of the shank has a substantially rectangular cross-section and wherein the second annular channel of the cover has a substantially rectangular cross-section.

20. The drill bit according to claim 19, wherein the first annular channel opens in a first radial direction and the second annular channel opens in a second radial direction opposite the first radial direction.

* * * * *